US005531626A

United States Patent [19]

Deal

[11] Patent Number: 5,531,626

[45] Date of Patent: Jul. 2, 1996

[54] TOY WATER BOMB DEVICE

[76] Inventor: Jeffry T. Deal, 278 Goat Hill Rd., Lambertville, N.J. 08530

[21] Appl. No.: 272,091

[22] Filed: Jul. 8, 1994

[51] Int. Cl.[6] ..... A63H 33/00

[52] U.S. Cl. ..... 446/473; 446/186; 446/475; 222/79

[58] Field of Search ..... 446/4, 473, 176, 446/180, 186, 197, 220, 222, 224, 267, 475; 222/78, 79, 212; 434/11, 14, 15; 102/488, 498, 529, 353–354, 355; 251/4

[56] References Cited

U.S. PATENT DOCUMENTS

| | | | |
|---|---|---|---|
| 1,986,484 | 1/1935 | Schlveter . | |
| 2,844,351 | 7/1958 | Smith . | |
| 3,486,539 | 12/1969 | Jacuzzi . | |
| 3,878,639 | 4/1975 | Scheeler . | |
| 4,135,559 | 1/1979 | Barnby . | |
| 4,194,461 | 3/1980 | Kubiatowicz . | |
| 4,212,460 | 7/1980 | Kraft . | |
| 4,257,460 | 3/1981 | Paranay et al. . | |
| 4,319,426 | 3/1982 | Lee . | |
| 4,458,830 | 7/1984 | Werding . | |
| 4,735,239 | 4/1988 | Salmon et al. . | |
| 4,854,480 | 8/1989 | Shindo . | |
| 4,890,838 | 1/1990 | Rudell et al. . | |
| 4,944,521 | 7/1990 | Greene | 273/428 |
| 4,991,847 | 2/1991 | Rudell et al. . | |
| 5,018,449 | 5/1991 | Edison . | |
| 5,174,477 | 12/1992 | Schafer | 222/78 |
| 5,240,450 | 8/1993 | Graham | 446/475 |
| 5,288,256 | 2/1994 | Lee et al. . | |
| 5,354,225 | 10/1994 | Hix | 446/473 |
| 5,366,108 | 11/1994 | Darling | 222/79 |

*Primary Examiner*—Robert A. Hafer
*Assistant Examiner*—Jeffrey D. Carlson
*Attorney, Agent, or Firm*—Kenneth P. Glynn

[57] ABSTRACT

The present invention is a toy water bomb device with a main housing which includes an upper portion and a lower portion rotatably connected to one another and a passageway through both the upper and lower portions for receiving a shut off valve. The shut off valve is located within the housing and connected to both the upper and the lower portions and adapted so that when the upper and lower portions are rotated relative to one another, the shut off valve is moved from an open position to a closed position. There is a locking mechanism connected to one of the upper and lower portions, and releasably connected to the other portion such that rotation of the upper portion relative to the lower portion will move the shut off valve to a closed position and the locking mechanism may then be used to hold the shut off valve in its closed position until subsequently released. There is also an expandable bladder which is filled with liquid and expends liquid when the device is activated and the valve is opened.

17 Claims, 7 Drawing Sheets

TOY WATER BOMB DEVICE

BACKGROUND OF THE INVENTION

1. Field of the Invention

The present invention relates to toy water bomb devices and, more particularly, such toy devices which release an explosive water burst upon impact or based on time delay, shortly after impact. It relies upon a spring loaded timing mechanism and an upper portion and lower portion of a main housing which cooperate so as to simultaneously shut off a valve and set a spring and timing mechanism when rotated relative to one another by a user.

2. Information Disclosure Statement

Water guns and water toys have been popular with children for decades. The following patents are representative of toys and other devices which utilize bladders for containing and subsequently expelling water or involve water bomb type toys:

U.S. Pat. No. 5,288,256 to Lee et al. describes a thrown water propelling and dispensing toy. The thrown toy has a water tank with valves which are opened by centrifugal force. When thrown, the toy is designed to whirl so that the centrifugal force opens a valve and water is dispersed out the valves while the toy is in flight.

U.S. Pat. No. 4,991,847 to Rudell et al. describes a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,890,838 to Rudell et al. describes a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 4,458,830 to Werding describes an appliance for discharging a non-compressible liquid, creamy or pasty product under pressure. The container of rigid material comprises an appliance which employs the contractional force of an expanded rubber hose and an expanded product container for the discharge of a medium stored therein. A hollow body of elastic material located in the axis of a product container is provided with a valve at one end through which it is inflated. The shape of the inner walls of the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

U.S. Pat. No. 4,257,460 to Paranay et al. describes a water gun. The novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body and a trigger mechanism may be employed for selectively releasing the pressurized water within the storage compartment.

U.S. Pat. No. 4,212,460 to Kraft describes a hollow water-filled game toy. The hollow body is provided having two complementary parts releasably joined about interfitting rim portions. When the parts are joined, the hollow body may be compressed to partially deform a portion of the rim structure into an opening thereby allowing the filling of water into the body interior. After deformation the parts resume their original shape. An effective hermetic seal to retain the water within the interior is formed by squeezing the body and purging air through the vents in the rim portions. The water-filled body may then be thrown against a stationary object whereby the force of impact will release the seal and allow the water to become suddenly released causing a splashing action. The complementary hollow parts may be subsequently rejoined and refilled with water to repeat the throwing and splashing action.

U.S. Pat. No. 4,135,559 to Barnby describes a water squirt toy and fill valve combination. The water squirt toy apparatus includes a combination of a water squirt toy and a special filling valve which function together cooperatively. The water squirt toy includes a resiliently expansible tubular member serving as a water reservoir and encased within a rigid tubular support member, and a manually operated, lever-type normally closed valve mechanism operatively associated with the expansible member for permitting or preventing fluid discharge therefrom by compressing or pinching the same. The forward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals into the water supply whereby the discharged streams will coalesce and exhibit reduced separation so as to be discharged over significantly greater distances; and amusement apparatus which is particularly adaptable for use with the water squirt toy is also disclosed.

U.S. Pat. No. 3,486,539 to Candido Jacuzzi describes a liquid dispensing and metering assembly. The liquid dispensing and metering assembly in which an expansible receptacle of a material adapted to maintain constant pressure characteristics over a substantial change in volume of liquid content of such receptacle, discharges through a slow rate metering-element to provide a uniform discharge flow at a low constant pressure.

SUMMARY OF THE INVENTION

The present invention is a toy water bomb device with a main housing which includes an upper portion and a lower portion rotatably connected to one another and a passageway through both the upper and lower portions for receiving a shut off valve. The shut off valve is located within the housing and connected to both the upper and the lower portions and adapted so that when the upper and lower portions are rotated relative to one another, the shut off valve is moved from an open position to a closed position. There is a locking mechanism connected to one of the upper and lower portions, and releasably connected to the other portion such that rotation of the upper portion relative to the lower portion will move the shut off valve to a closed position and the locking mechanism may then be used to releasably lock the upper and lower portions relative to one another to hold the shut off valve in its closed position until subsequently released. There is also an expandable bladder which is filled with liquid and expends liquid when the device is activated and the valve is opened.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention toy water bomb device may be characterized as a water grenade, a toy water land mine or otherwise, but its essential feature is that it has a fillable bladder which may be shut off either for a predetermined time or a delayed time or at least until a release is moved to an open position (e.g. by impact) so as to cause a bursting of the water therefrom to simulate a water "explosion". The present invention device essentially also includes a main housing which is rotatable so as to move a valve from an open position to a closed position for subsequent release thereof.

Figure 1:
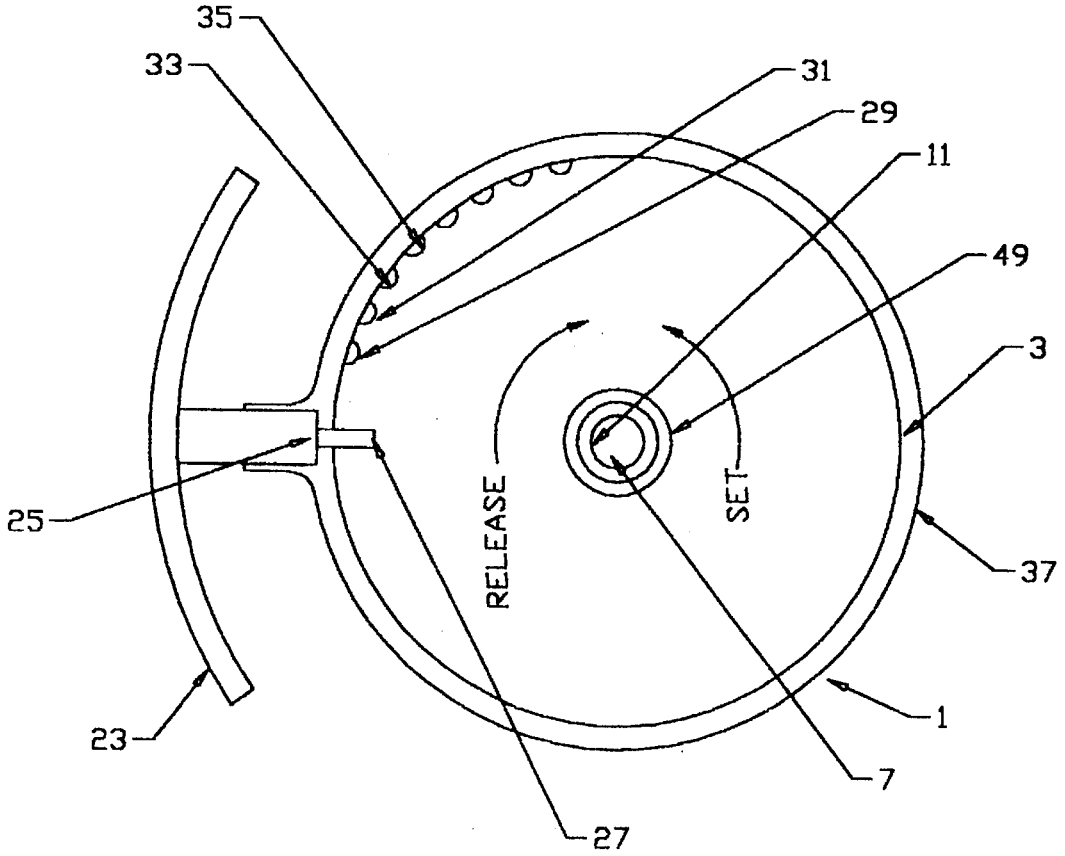
FIGS. 1 and 2 show respectively a top view and a side cut view of a present invention toy water bomb device in its unfilled mode.
Figure 3:
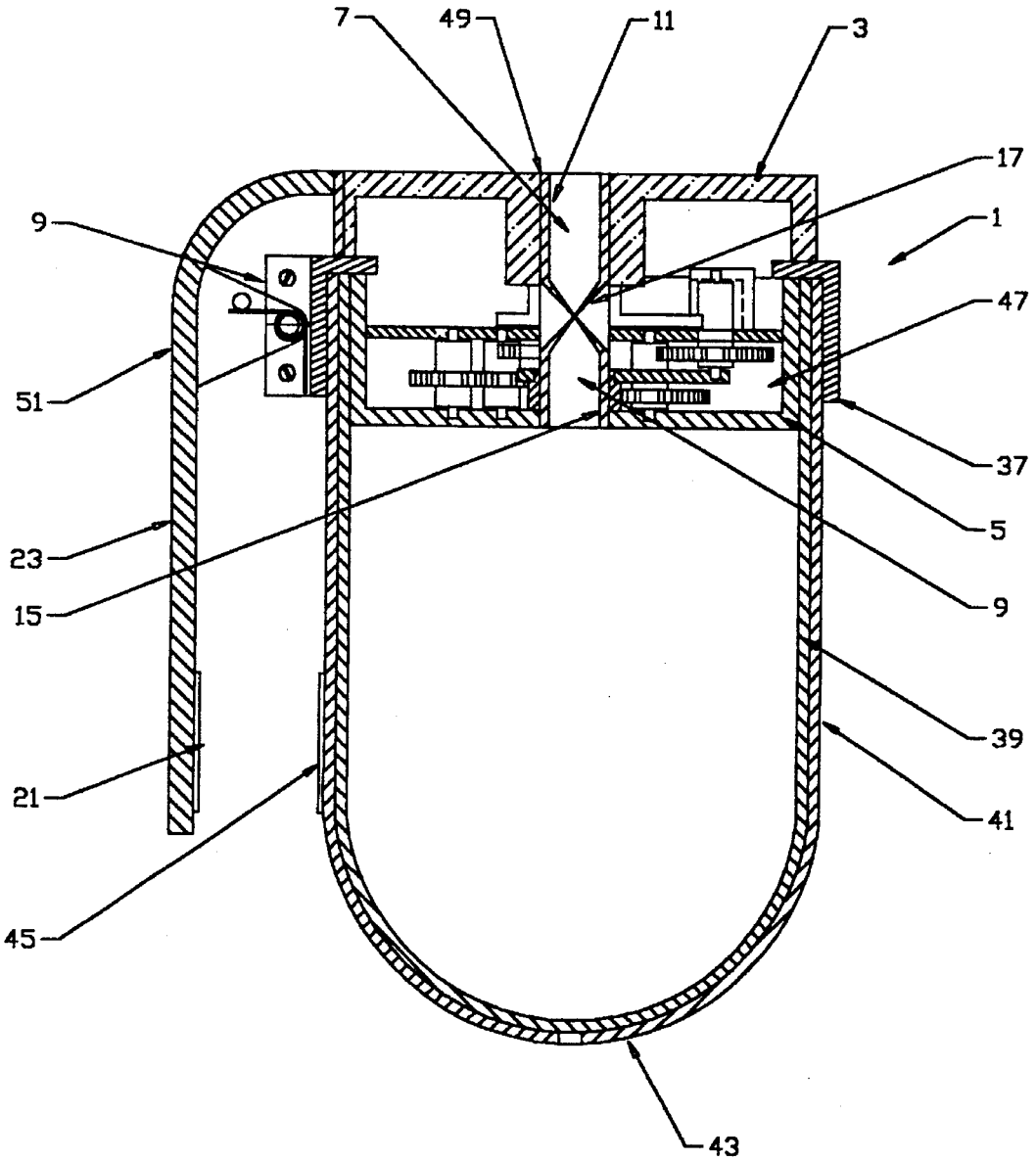
FIG. 3 shows the device shown in FIGS. 1 and 2 but filled with fluid and with the shut-off valve in the closed position.

Referring now to FIG. 1 there is shown toy water bomb device 1 having a main housing upper portion 3 and a main housing lower portion 5. There is a passageway which is broken into upper portion passageway 7 and lower portion passageway 9 and contained therein is a flexible tube shut-off valve 11, with its upper end 13 and its lower end 15, as shown. Upper end 13 of flexible tube shut-off valve 11 is fixably attached to main housing upper portion 3 (e.g. by being heat sealed, glued, clamped or otherwise). Likewise, lower end 15 of flexible tube shut-off valve 11 is fixably attached to main housing lower portion 5. Thus, upper portion 3 and lower portion 5 are rotatably connected to one another and the flexible tube shut-off valve 11 is free to be twisted from opened to closed positions at its middle section 17. Thus, when upper portion 3 and lower portion 5 are rotated relative to one another, then flexible tube shut-off valve 11 will be twisted from its opened to its closed position. This is illustrated in FIG. 3 discussed below. Additionally, there is a rigid, flanged, gear-toothed tube 49 fixably connected to upper portion 3 and this rotates with the rotation of upper portion 3 and is connected by its flanged portion to a timing mechanism shown internally as mechanism 47. This would be a set of gears and a spring which would operate like a clock for a chess game, an egg timer, or any other internal mechanism. These spring loaded winding, timing mechanisms are well within the skill of the artisan although not in the context of the present invention. Thus, while one set of gears and spring is shown generally as timing mechanism 47, any such known timing mechanism which relies upon rotational movement for setting and unwinding could be used without exceeding the scope of the present invention. Thus, when upper portion 3 is rotated relative to lower portion 5, flanged, gear-toothed tube 49 rotates the gears within timing mechanism 47 so as to wind up a spring and, optionally set a time.

Figure 2:
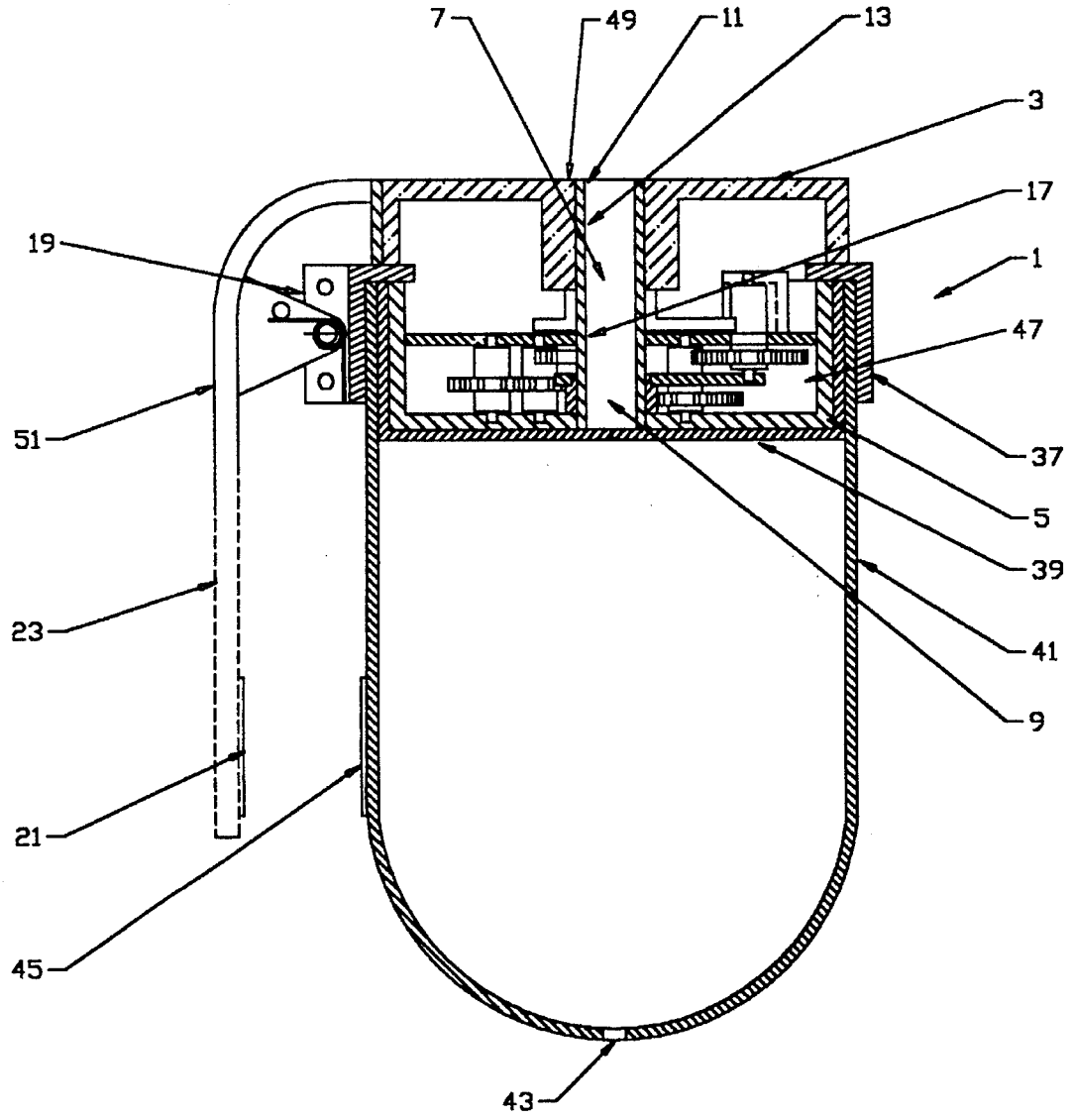

Referring both to FIGS. 1 and 2, and particularly in FIG. 1, upper portion 3 includes a series of stop indentations shown generally as indentations 27, 29, 31, 33 and 35, although others are also shown. There is a locking means 19 which is connected to a torsion spring 51 and it includes locking means setting protrusion 25, which, in FIG. 1, is set in a first stop indentation 27. This could be an instantaneous release setting whereby a user would rotate upper portion 3 relative to lower portion 5 and allow locking means 19 setting protrusion 25 to be biased inwardly so as to be released at stop 27. Thus, when the locking means extension 23 is pushed inward and, optionally, attachment mechanism 21 would attach to receiver 45, the protrusion 25 would pull away from stop indentation 27 and the spring would cause upper portion 3 to rotate, thereby opening flexible tube shut-off valve 11. A user could, alternatively, rotate the upper portion 3 relative to lower portion 5 to a greater extent and rely upon the other stop indentations mentioned above. These could be related to timing such as multiples of ten seconds, or otherwise and the further around the upper portion would be rotated, the longer the delay time would be before the valve would be totally opened and a pressurized water or other fluid content would be released in the form of an "explosion". Clamp ring 37 holds bladder 39 onto main housing lower portion 5, but this could be otherwise attached, as by rivets, a bladder having an inner bead ring before it's fitted into a formed concomitant indentation in main housing lower portion 5, or otherwise. In any event, bladder 39 is contained in outer shell 41. This is optional and need not be included, but would prevent the volume of bladder 39 from expanding beyond the volume of outer shell 41. There is a vent hole 43 which allows air to exit outer shell 41 as bladder 39 is expanded therein. Thus, a fitting such as that shown in FIG. 5 would be inserted into the top of flexible tube shut-off valve 11.

Figure 5:
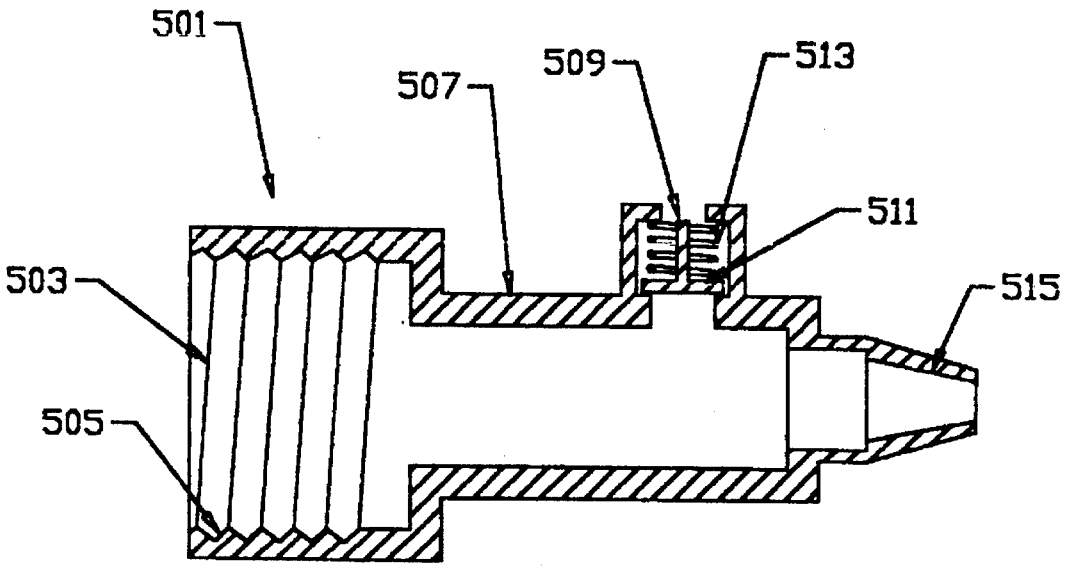
FIG. 5 shows a side cut view of a filling mechanism useful in the present invention toy water bomb device; and, FIGS. 6 and 7 show respectively a top view and a side cut view of a present invention toy water bomb device in its unfilled mode, without the inclusion of a locking mechanism.

Referring to both FIGS. 3 and 5, there is shown in FIG. 5 a filling mechanism 501 having a top with threads 505 adapted to be attached to a standard garden hose or an outdoor threaded faucet. It has a main chamber 507 with a side water pressure release valve 509 which includes a spring and a plunger valve 511. There is an outlet 515 which is adapted to fit into flexible tube shut-off valve 11, as mentioned. This fill device 501 is inserted as indicated, after it has been attached to a garden hose or faucet or otherwise, water is released by opening a valve or faucet and the water expands bladder 39, in this case a diaphragm, so as to completely fill up the volume of outer shell 41, as shown in FIG. 3. Then, a user rotates upper portion 3 relative to lower potion 5 of the main housing so as to twist the middle section 17 of flexible tube shut-off valve 11 so as to render it closed as shown in FIG. 3. Locking means extension protrusion 25 would be locking into whatever stop the user selected and, when locking means extension 23 was impacted upon, the upper portion 3 would rotate so as to open flexible tube shut-off valve 11 and the contents bladder 39 would be forced out through flexible tube shut-off valve 11 in an explosive fashion. This would occur either instantaneously upon impact of locking means extension 23 or after a timed delay depending upon the setting chosen by the user.

Figure 4:
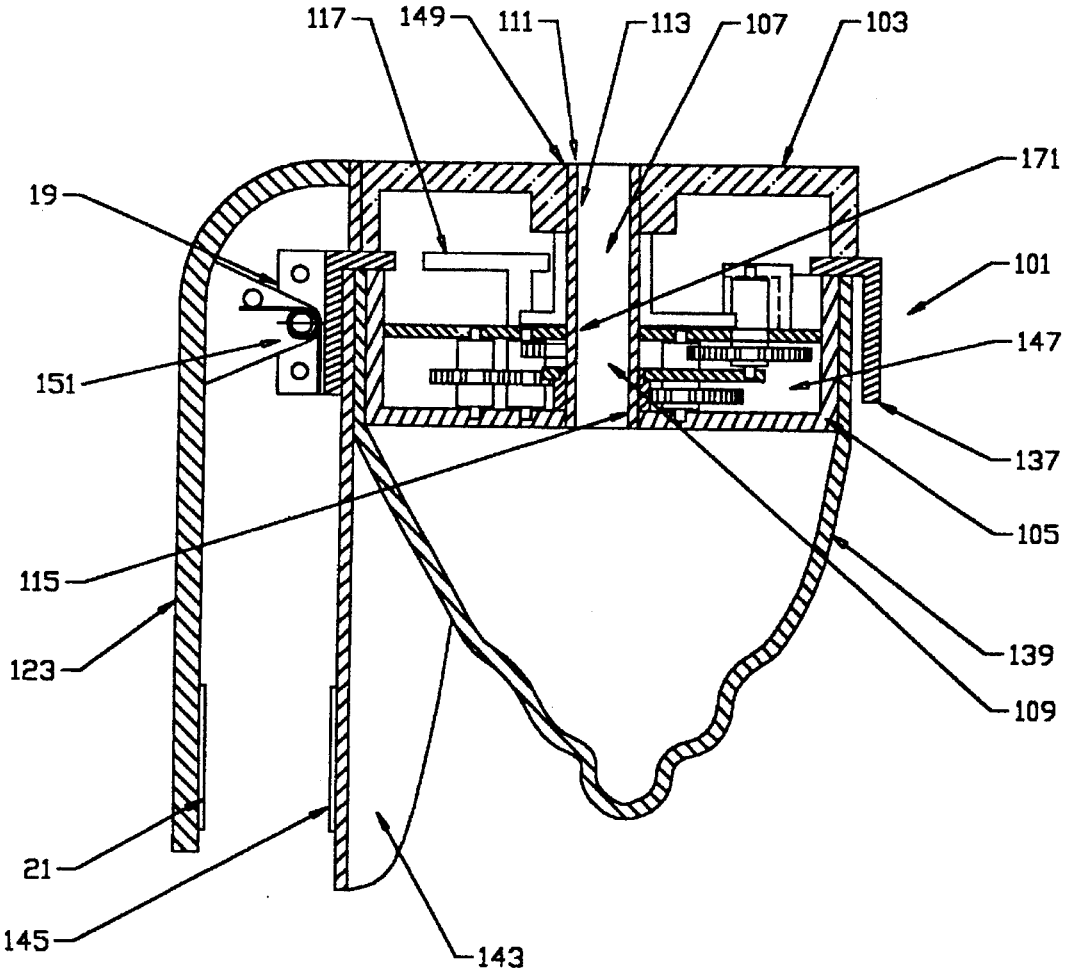
FIG. 4 shows a side cut view of an alternative embodiment present invention toy water bomb device.

FIG. 4 shows another embodiment of the present invention, in this case, there is a toy device 101 with a main housing upper portion 103 and a main housing lower portion 105 which includes an outer sheath 143 and a balloon 139 which is attached to lower portion 105 and held in place by clamp 137. Timing mechanism 147 is similar to that disclosed above, but in place of a flexible tube shut-off valve, there is the flanged, gear-toothed tube 149 which has an opening cut therein through which shutter valve 117 may pass so as to close off or open the passageway which includes upper portion passageway 107 and lower portion passageway 109. There is a fixed tubing 111 with an upper portion 113 and a lower portion 115 which basically replaces the flexible tubing mentioned above and also is cut out so that the shutter 117 may pass therethrough. Balloon 139 is filled similarly to diaphragm bladder 39 discussed above and the release mechanism 119 with its locking means extension 123, its torsion spring 151, attachment mechanism 121 and receiver 145, all work similar to that described with respect to FIGS. 1 through 3 above. Gears on a shaft of the shutter 117 are meshed to the gears of timing mechanism 147 and as the timing mechanism is wound by the rotation of upper portion 103 relative to lower portion 105, the turning of the gears of timing mechanism 147 causes the gears of shutter 117 to close off the passageway to prevent liquid from exiting until locking mechanism 119 is released.

Figure 6:
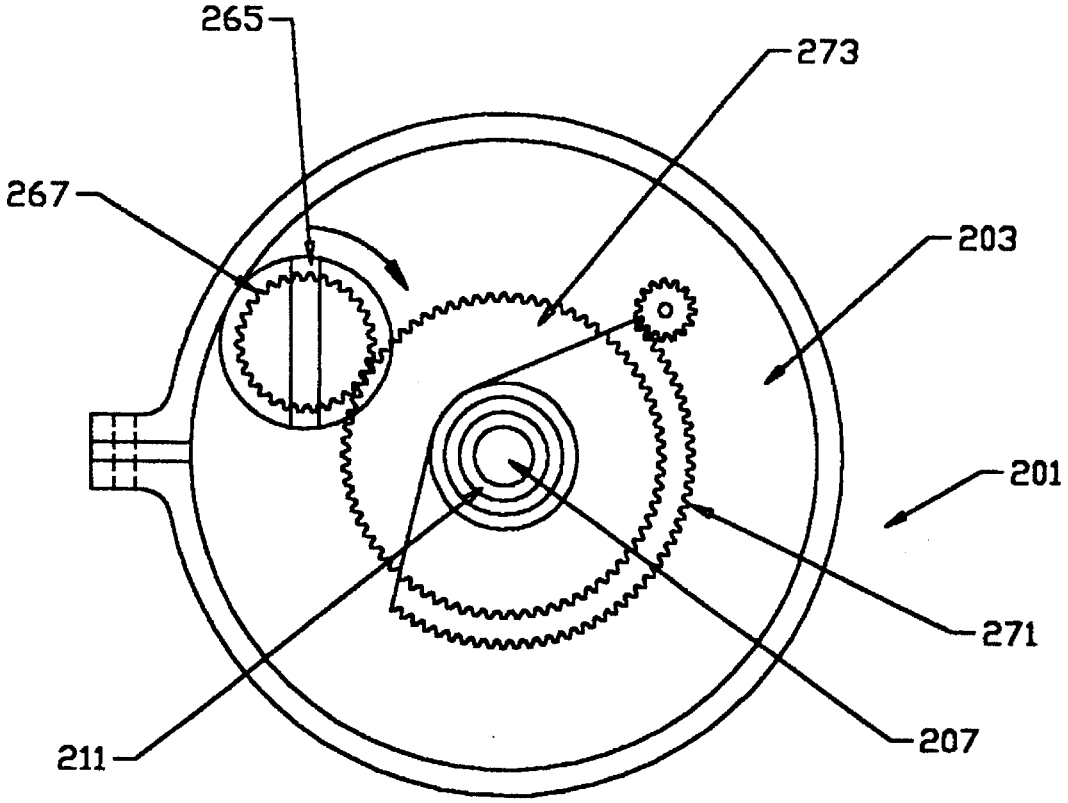

Referring now to FIG. 6 there is shown toy water bomb device 201 having a main housing upper portion 203 and a main housing lower portion 205. Bladder 239 is shown in its unfilled position. There is a passageway which is broken into upper portion passageway 207 and lower portion passageway 209 and contained therein is a flexible tube shut-off valve 211, with an upper poriton of upper end 213 and its lower end 215, as shown. In this embodiment, upper portion 203 and lower portion 205 are not rotatably connected to one another but a lower portion of the upper end 213 of flexible tube shut-off valve 211 with its outer jacket 212 is rotatable within upper portion 203 and lower portion 205 so that lower end 215 remains stationary and upper end 213 rotates so as to cause a twisting flexible tube shut-off valve 211 from opened to closed positions at its middle section 217. Thus, flexible tube shut-off valve 211 will be sealed and fluid expulsion prevented when twisted from its opened to its closed position. Outer jacket 212 includes flanged gears 271 and 273 which are connected to timing mechanism 247 and winding gear 267. Winding gear 267 is connected by a rod 269 to winding button 265. Thus, a user will wind winding button 265 to both close flexible tube shut-off valve 211 and to set timing mechanism 247. Mechanism 247 would be a set of gears and a spring which would operate like a clock for a chess game, an egg timer, or any other internal mechanism. These spring loaded winding, timing mechanisms are well within the skill of the artisan although not in the context of the present invention. Thus, while one set of gears and spring is shown generally as timing mechanism 247, any such known timing mechanism which relies upon rotational movement for setting and unwinding could be used without exceeding the scope of the present invention.

Figure 7:
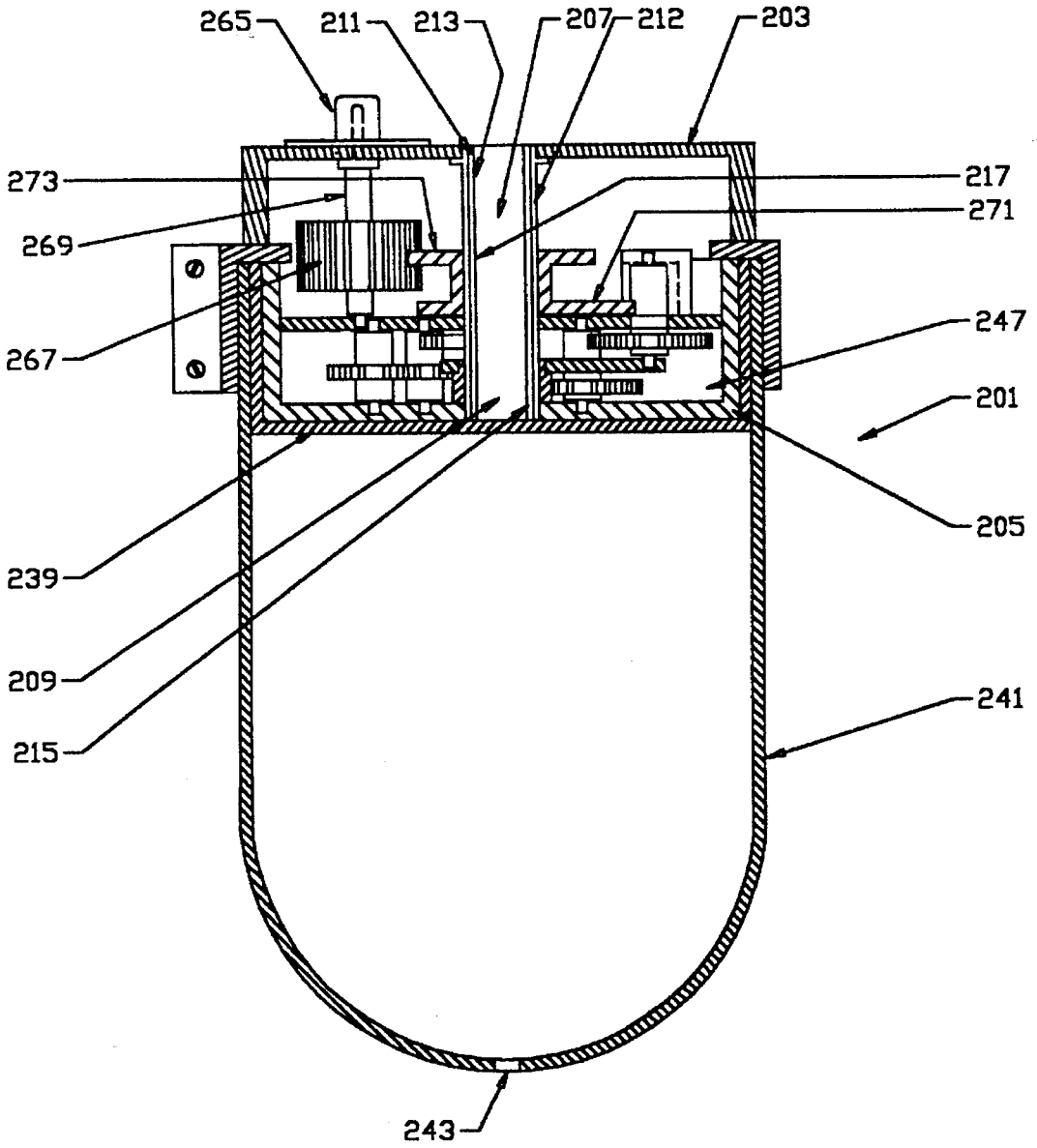

Obviously, numerous modifications and variations of the present invention are possible in light of the above teachings. For example, while the present invention device is efficiently developed and designed so as to utilize the shut-off valve both as a fill port and as the exit port, a more complicated and more costly embodiment could include a separate fill port and shut-off valve remotely located from the exit release valve but directly or indirectly connected to the bladder without exceeding the scope of the present invention. Also, for example, the device shown in FIGS. 6 and 7 could include a locking mechanism by merely slotting a portion of the perimeter of winding button 265 and relying upon a locking mechanism similar to the one shown in, for example, FIGS. 1 and 2. It is therefore understood that within the scope of the appended claims, the invention may be practiced otherwise than as specifically described herein.

What is claimed is:

1. A toy water bomb device, comprising:

(a) a main housing having an upper portion and a lower portion rotatably connected to one another and having a passageway through both of said upper portion and lower portion for receiving a shut off valve;

(b) a shut off valve located within said main housing and connected to said upper portion and said lower portion of said main housing and adapted so that when said upper portion and said lower portion of said main housing are rotated relative to one another, said shut off valve is moved from an open position to a closed position;

(c) locking means connected to one of said upper portion and said lower portion of said main housing and releasably connected to the other of said upper portion and said lower portion of said main housing such that said upper portion may be rotated relative to said lower portion to move said shut off valve to a closed position and said locking means may then be used to releasably lock said upper portion and said lower portion relative to one another to hold said shut off valve in its closed position until subsequently released; and, (d) an expandable bladder connected to said lower portion of said main housing so that fluid may pass through said shut off valve and expand said expandable bladder to a predetermined volume of fluid, said upper portion of said main housing may be rotated relative to said lower portion so as to move said shut off valve to its closed position, and said locking means may then lock said device in a filled bladder, closed valve position, whereby said locking means may be subsequently released such that said expandable bladder will rapidly contract and expel fluid through said shut off valve to simulate a water explosion.

2. The device of claim 1 wherein said main housing includes a timing mechanism which may be locked when said locking means is in a locked position and when said locking means is released, said timing mechanism causes a delay for a predetermined time period before said upper portion of said main housing rotates adequately relative to said lower portion of said main housing to open said shut off valve.

3. The device of claim 2 wherein said timing mechanism is arranged within main housing and arranged relative to said locking means so as to have a selection of a plurality of predetermined delay time settings.

4. The device of claim 3 wherein said plurality of predetermined delay time settings includes a setting for zero time delay.

5. The device of claim 1 wherein said locking means is hinged with a protruding portion so as to be releasable upon impact of said protruding portion.

6. The device of claim 1 wherein said flexible bladder is a diaphragm.

7. The device of claim 1 wherein said flexible bladder is a tube which has a distal end which is closed.

8. The device of claim 1 wherein said flexible bladder is a balloon.

9. The device of claim 1 further including an outer shell member attached to said main housing and over said flexible bladder and having a predetermined volume so as to limit the maximum expansion of said bladder.

10. The device of claim 1 wherein said device further includes a removable fill mechanism having an inlet which is attachable to a threaded faucet, a pressure relief valve set to open at a predetermined pressure and an insertable outlet adapted to fit into said passageway of said main housing.

11. A toy water bomb device, comprising:

(a) a main housing having an upper portion and a lower portion rotatably connected to one another and having a passageway through both of said upper portion and lower portion for receiving a flexible tube shut off valve;

(b) a flexible tube shut off valve having an upper end and lower end and being located within said passageway so that said upper end is fixedly connected to said upper portion of said main housing and said lower end is fixedly connected to said lower portion of said main housing;

(c) locking means connected to one of said upper portion and said lower portion of said main housing and releasably connected to the other of said upper portion and said lower portion of said main housing such that said upper portion may be rotated relative to said lower portion to twist said flexible tube shut off valve to a closed position and said locking means may then be used to releasably lock said upper portion and said lower portion relative to one another to hold said flexible tube shut off valve in its twisted, closed position until subsequently released; and, (d) an expandable bladder connected to said lower portion of said main housing so that fluid may pass through said flexible tube shut off valve and expand said expandable bladder to a predetermined volume of fluid, said upper portion of said main housing may be rotated relative to said lower portion so as to twist said flexible tube shut off valve to its closed position, and said locking means may then lock said device in a filled bladder, closed valve position whereby said locking means may be subsequently released such that said expandable bladder will rapidly contract and expel fluid through said flexible tube shut off valve to simulate a water explosion.

12. The device of claim 11 wherein said main housing includes a timing mechanism which may be locked when said locking means is in a locked position and when said locking means is released, said timing mechanism causes a delay for a predetermined time period before said upper portion of said main housing rotates adequately relative to said lower portion of said main housing to open said flexible tube shut off valve.

13. The device of claim 12 wherein said timing mechanism is arranged within main housing and arranged relative to said locking means so as to have a selection of a plurality of predetermined delay time settings.

14. The device of claim 13 wherein said plurality of predetermined delay time settings include a setting for zero time delay.

15. The device of claim 11 wherein said locking means is hinged with a protruding portion so as to be releasable upon impact of said protruding portion.

16. The device of claim 11 further including an outer shell member attached to said main housing and over said flexible bladder and having a predetermined volume so as to limit the maximum expansion of said bladder.

17. The device of claim 11 wherein said device further includes a removable fill mechanism having an inlet which is attachable to a threaded faucet, a pressure relief valve set to open at a predetermined pressure and an insertable outlet adapted to fit into said flexible tube shut off valve.

* * * * *